US006666123B1

(12) United States Patent
Adams et al.

(10) Patent No.: US 6,666,123 B1
(45) Date of Patent: Dec. 23, 2003

(54) METHOD AND APPARATUS FOR ENERGY AND DATA RETENTION IN A GUIDED PROJECTILE

(75) Inventors: Tovan L. Adams, Tucson, AZ (US); Eric C. Maugans, Tucson, AZ (US); W. Norman Lange, Jr., Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/158,741

(22) Filed: May 30, 2002

(51) Int. Cl.[7] ..... F42C 17/04
(52) U.S. Cl. ..... 89/6.5
(58) Field of Search ..... 89/6, 6.5

(56) References Cited

U.S. PATENT DOCUMENTS

| | | | | | |
|---|---|---|---|---|---|
| 4,091,734 | A | * | 5/1978 | Redmond et al. | 250/199 |
| 4,454,815 | A | * | 6/1984 | Beck | 89/6.5 |
| 4,495,851 | A | * | 1/1985 | Koerner et al. | 89/6.5 |
| 4,736,681 | A | * | 4/1988 | Hall et al. | 89/6.5 |
| 5,343,795 | A | * | 9/1994 | Ziemba et al. | 89/6.5 |
| 5,397,079 | A | | 3/1995 | Strentz et al. | |
| 5,994,998 | A | * | 11/1999 | Fisher et al. | 340/310.01 |
| 6,268,785 | B1 | * | 7/2001 | Kollman et al. | 336/212 |
| 6,628,785 | B1 | | 7/2002 | Kollman et al. | |

FOREIGN PATENT DOCUMENTS

| | | | | |
|---|---|---|---|---|
| DE | 2 316 967 | * | 10/1974 | 89/6.5 |
| DE | 38 22 255 A1 | * | 1/1990 | 89/6.5 |
| IT | 286 270 | * | 7/1931 | 89/6 |
| JP | 2-230100 | * | 9/1990 | 89/6 |

* cited by examiner

*Primary Examiner*—Stephen M. Johnson
(74) *Attorney, Agent, or Firm*—Gregory J. Gorrie; Thomas J. Finn; Glenn H. Lenzen, Jr.

(57) ABSTRACT

Energy (110) and mission data (108) for a guided projectile are transferred from a projectile setter (102) over an inductive interface (118). The projectile may include energy storage element (114) to store the energy and a data storage element (112) to store the mission data. Precision GPS clock circuitry (316) of the projectile may receive power from a capacitive energy storage (304) element during projectile loading until a flight battery (320) is activated. In one embodiment, the capacitive energy storage element (304) includes at least one super capacitor (322) and a gun-hardened capacitor (324). The clock circuitry (316) may receive power from the gun-hardened capacitor (324) if the super capacitor (322) fails during the launching operation. The capacitive energy storage element (304) may include one-way energy transfer elements (326) coupled between the super capacitor (322) and the gun-hardened capacitor (324). A regulator (312) may be coupled to an output of the capacitive storage element (304) to regulate an input voltage to the clock circuitry (316).

21 Claims, 4 Drawing Sheets

METHOD AND APPARATUS FOR ENERGY AND DATA RETENTION IN A GUIDED PROJECTILE

TECHNICAL FIELD

The present invention pertains to energy and data transfer, and in one embodiment, the present invention pertains to energy and mission data retention in guided weapons.

BACKGROUND

Guided projectiles, including fuses, missiles and other weapons, generally need to be activated quickly. Conventional guided projectiles use a data interface to download mission data prior to launch and deployment. The mission data may include navigation data as well as initialization data for use by the projectile's Global Positioning System (GPS). The data may be downloaded quickly in order to launch projectiles at a rapid rate. Circuitry on the guided projectile is conventionally connected to a data-hold battery. The data-hold battery supplies power to the GPS circuitry and other circuitry prior to and during an initial portion of the projectile's deployment. The data-hold battery may be a chemical battery designed for a one-time initiation and may be ignited after mission data transfer by mixing or combining chemicals. Chemically ignited data-hold batteries may be dormant until activated allowing for a longer shelf life.

One disadvantage with the use of data-hold batteries is that they require the projectile be deployed relatively soon after the mission data has been transferred. One reason for this is that data-hold batteries generally do not allow for recharging without degradation in performance. For example, in some combat situations, a data-hold battery may be required to hold the mission data and power the GPS circuitry for many days on one charge. If the projectile is not deployed within a certain time frame, the data-hold battery must be replaced and the mission data may have to be transferred again to the projectile.

Another disadvantage with the use of data-hold batteries in guided projectiles is safety. A chemically ignited data-hold battery requires the combining and/or mixing of typically hazardous chemicals. Another disadvantage with the use of data-hold batteries is their high-cost.

Thus there is general need for improved method and apparatus for energy storage and data retention suitable for use in guided projectiles. There is also a need for a system and method for energy storage and data retention that permits recharging without performance degradation. There is also a need for a system and method for energy storage and data retention suitable for use in a guided projectile that does not require replacement of a data-hold battery when the projectile is not deployed within a certain time frame. There is also a need for a system and method for energy storage and data retention that does not use a data-hold battery.

BRIEF DESCRIPTION OF THE DRAWINGS

The appended claims point out different embodiments of the invention with particularity. However, the detailed description presents a more complete understanding of the present invention when considered in connection with the figures, wherein like reference numbers refer to similar items throughout the figures and:

DETAILED DESCRIPTION

Figure 1:
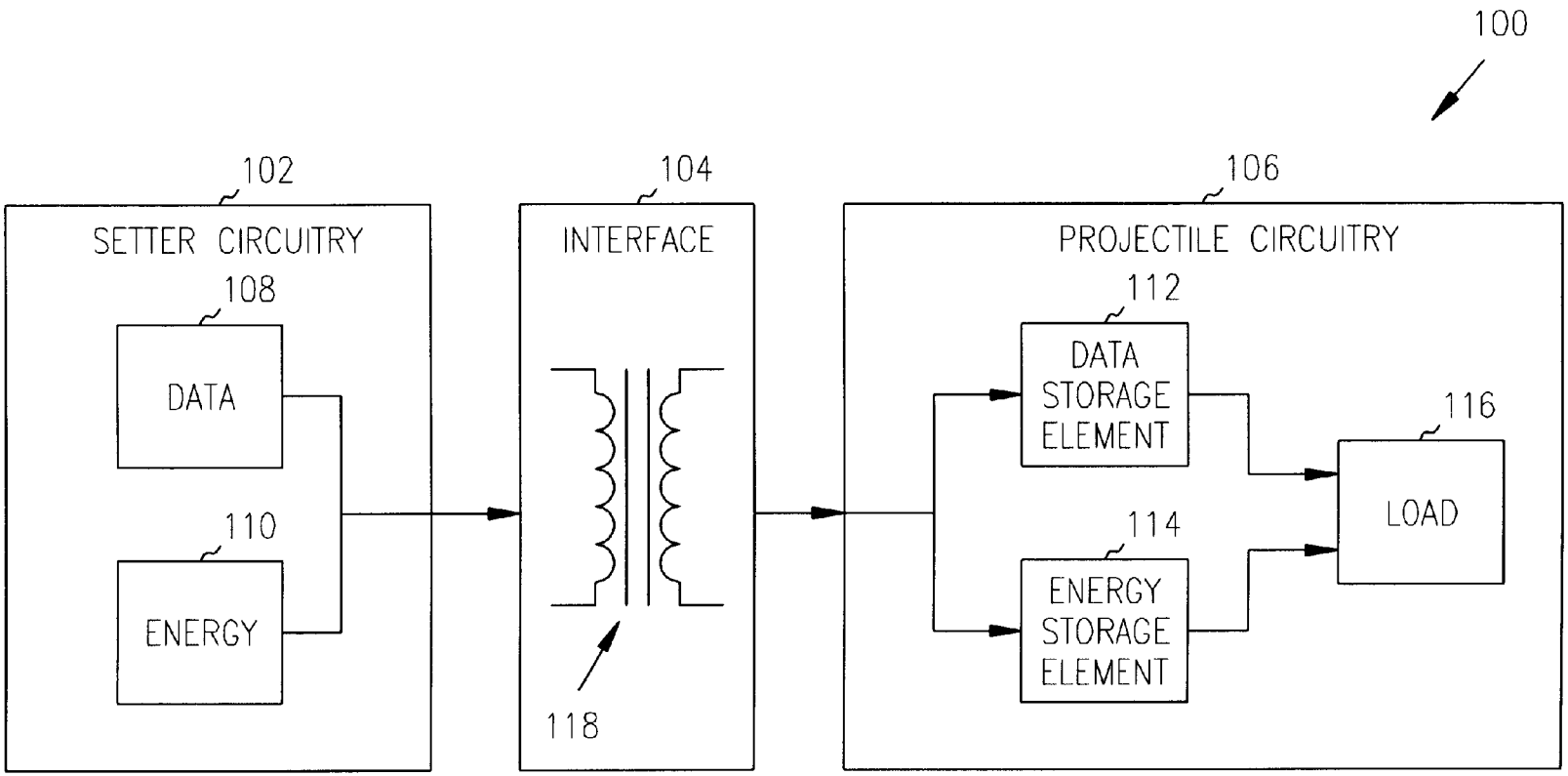
FIG. 1 is a functional block diagram of a system for transferring energy and mission data in accordance with an embodiment of the present invention.

The following description and the drawings illustrate specific embodiments of the invention sufficiently to enable those skilled in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents.

In one embodiment, the present invention provides an apparatus to retain energy and data in a guided projectile. In this embodiment, energy and mission data for the guided projectile are transferred from a projectile setter over an inductive interface. The projectile may include a capacitive energy storage element to store the energy and a data storage element to store the mission data. Precision GPS clock circuitry of the projectile may receive power from the capacitive energy storage element during projectile loading and launching operations until a flight battery is activated. In one embodiment, the capacitive energy storage element includes at least one super capacitor and a second capacitor, which may be a gun-hardened capacitor. The clock circuitry may receive power from the gun-hardened capacitor if the super capacitor fails during the launching operation. The capacitive energy storage element may include one-way energy transfer elements coupled between the super capacitor and the gun-hardened capacitor to help prevent discharge of the gun-hardened capacitor into the super capacitor, which may be damaged by the launch environment. A regulator may be coupled to an output of the capacitive storage element to regulate an output voltage.

In another embodiment, the present invention provides a method for storing energy and data. The method may include receiving energy and data over an interface, charging a capacitive storage element with the received energy, and storing the received data in a data storage element. The energy may be provided to clock circuitry until another energy source is activated. In one embodiment, the energy and data may be received over an inductive interface of a guided projectile. In this embodiment, the data may be mission data for the guided projectile and the other energy source may include a flight battery of the guided projectile. The receiving, charging and storing may be performed during projectile setting operations, and the energy may be provided to precision GPS clock circuitry subsequent to the projectile setting operations and during loading and launching operations of the guided projectile. In this embodiment, the capacitive storage element may comprise a super capacitor and a secondary capacitor. Energy stored in the secondary capacitor may be provided to the clock circuitry if the super capacitor fails during the launching operation.

FIG. 1 is a functional block diagram of a system for transferring energy and mission data in accordance with an embodiment of the present invention. System 100 may be used to transfer data and/or energy to an apparatus, such as a guided projectile. Guided projectiles include, for example, fuses, missiles and other guided weapons, which may be configured to use mission data. System 100 may include setter circuitry 102, interface 104 and projectile circuitry 106. Setter circuitry 102 may transfer mission data 108 and energy 110 to interface 104. Projectile circuitry 106 receives the mission data and/or energy from interface 104 and may store the mission data in data storage element 112 and the energy in energy storage element 114. Energy in energy storage element 114 may provide power to load 116 until another power source becomes available. In one embodiment, energy from energy storage element 114 may also provide power to data storage element 112 for data retention until another power source becomes available.

Setter circuitry 102 may include other functional elements (not illustrated) to configure the data and energy for transfer across interface 104, depending on whether interface 104 is a mechanical-type interface or, for example, an inductive interface. In the case of an inductive interface, setter circuitry 102 may include functional elements to convert energy 110, for example, to an alternating current waveform. Setter circuitry 102 may also include functional elements to modulate data 108 on the waveform.

In a guided projectile embodiment of the present invention, mission data 108 may include GPS information and navigational information, and load 116 may include a precision clock, such as a GPS clock or precision oscillator. In this embodiment, energy in energy storage element 114 provides power to load 116 until a flight energy source, such as a flight battery becomes available shortly after deployment of the projectile.

Interface 104 may be a connector-less interface, such as inductive interface 118, comprised of one or more sets of windings on the projectile setter and one or more sets of windings on the projectile. Data and energy may be transferred from the one or more sets of windings of the projectile setter to the one or more sets of windings of the projectile during projectile setting operations when, for example, the projectile setter is brought in close proximity to the projectile. Alternatively, interface 104 may be an electrical or mechanical interface comprising one or more mechanical and/or electrical connectors.

Although interface 104 is illustrated as a separate functional element from setter circuitry 102 and projectile circuitry 106, a first portion of interface 104 may be fabricated as part of a projectile setter, while a second portion of interface may be fabricated as part of the projectile. In the case of an inductive interface, the first portion may include, for example, first sets of windings and a magnetic core located on the projectile setter, and the second portion may include, for example, second sets of windings and a magnetic core located on the projectile.

Figure 2:
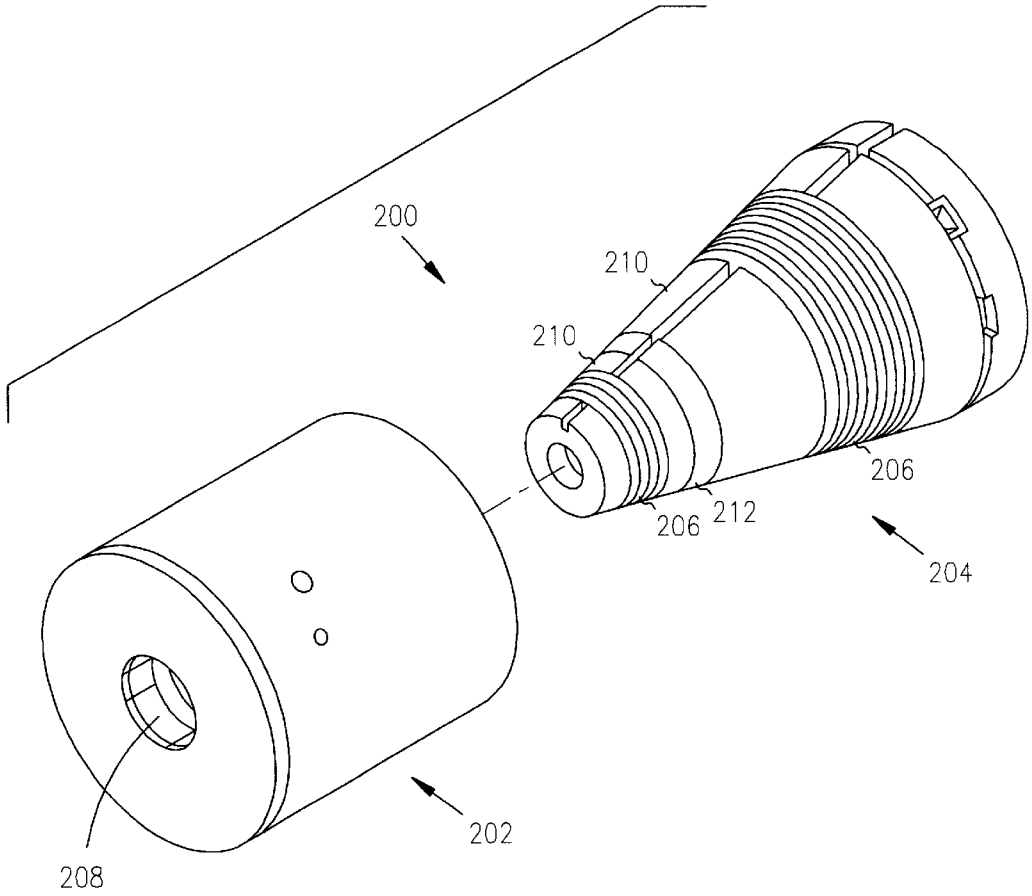
FIG. 2 illustrates an example projectile setter and portion of a guided projectile in accordance with an embodiment of the present invention.

FIG. 2 illustrates an example projectile setter and portion of a guided projectile in accordance with an embodiment of the present invention. Projectile setter 202 and projectile portion 204 may form connector-less interface 200 across which data and/or energy may be transferred. Connector-less interface 200 is one example of an inductive interface suitable for use as interface 118 (FIG. 1), although other interfaces are also suitable. Connector-less interface 200 may be comprised of one or more sets of windings 206 on projectile portion 204 and one or more sets of windings 208 in projectile setter 202. Windings 206 may be wound directly on magnetic cores 210 which may be separated by spacer 212. Windings 208 of setter 202, similarly, may be wound on magnetic cores (not illustrated). During energy and data transfer operations, projectile portion 204 may be inserted, or disposed, into setter 202 to form a transformer allowing the transfer of energy and data. One suitable inductive interface may be found in U.S. Pat. No. 6,268,785, which is incorporated herein by reference.

Figure 3:
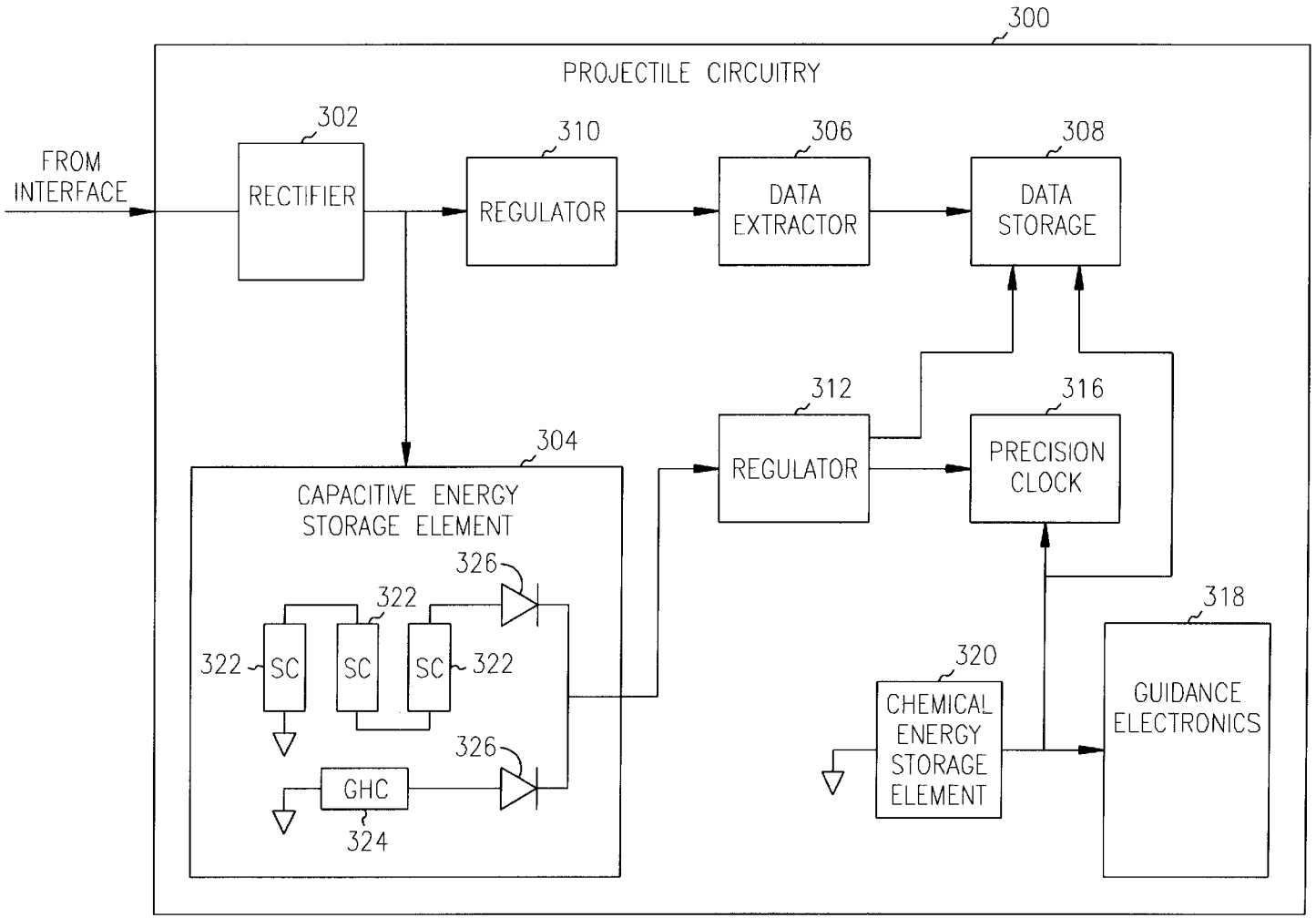
FIG. 3 is a functional block diagram of projectile circuitry in accordance with an embodiment of the present invention.

FIG. 3 is a functional block diagram of projectile circuitry in accordance with an embodiment of the present invention. Projectile circuitry 300 may be suitable for use as projectile circuitry 106 (FIG. 1) although other circuitry is also suitable. Projectile circuitry 300 may include rectifier 302 to rectify a waveform received from an interface, such as interface 104 (FIG. 1), and capacitive storage element 304 to store energy extracted from the rectified waveform. Projectile circuitry 300 may also include data extractor 306 to extract data from a waveform received from an interface, such as interface 104 (FIG. 1), and data storage element 308 to store the extracted data. Regulator 310 may regulate the voltage of the waveform for data extractor 306.

Data storage element 308 may be correspond with data storage element 112 (FIG. 1). Data storage element 308 may be comprised of volatile and/or non-volatile semiconductor memory devices, as well as other elements suitable for storage of digital information including, for example, magnetic memory and magnetic storage elements.

Capacitive energy storage element 304 may be suitable for use as energy storage element 114 (FIG. 1) although other energy storage elements are also suitable. Capacitive storage element 304 may provide an output voltage through regulator 312 for circuitry 316. Circuitry 316 may include precision clock and/or oscillator circuitry including, for example, a GPS time-synchronization clock. In one embodiment, regulator 312 may provide power to data storage element 308 for use in retaining stored data. For example, when data storage element 308 includes volatile memory, regulator 312 may provide a voltage to element 308. In one embodiment, capacitive storage element 304 may replace a data-hold battery conventionally used in guided projectiles.

In one embodiment of the present invention, data received over an interface may include mission data for use by a guided projectile. In this embodiment, energy and data may be transferred very rapidly over the interface. Capacitive energy storage element 304 may be charged rapidly and the mission data may be stored in data storage element 308 during projectile setting operations. During projectile setting operations, power may be supplied to elements of projectile circuitry 300 including guidance electronics 318. After projection setting operations and during firing, capacitive energy storage element 304 may provide power to precision clock circuitry 316 until chemical energy storage element 320 is activated after launch. Chemical energy storage element 320 may be a flight battery for use in powering guidance electronics 318 and precision clock 316, among other things, during projectile deployment. In one embodiment, the flight battery may be chemically ignited during launch. A controller (not illustrated) may control the operations of the various functional elements of projectile circuitry 300.

Capacitive energy storage element 304 may include primary capacitive energy storage elements, such as at least one super capacitor 322 for storing energy received from rectifier 302. In one embodiment, capacitive energy storage element 304 may include a backup-energy storage element, such as gun-hardened capacitor (GHC) 324, and one-way energy transfer elements 326 between super capacitor 322 and gun-hardened capacitor 324. Gun-hardened capacitor 324 may be a tantalum capacitor or surface mount capacitor, for example that may be gun hardened. One-way energy transfer elements 326 may be diodes. Gun-hardened capacitor 324 may serve as a back up energy storage element and in one embodiment, clock circuitry 316 may receive energy from gun-hardened capacitor 324 if super capacitor 322 fails during projectile launching (e.g., in the event super capacitor 322 may not be "gun hardened"). Capacitive energy storage element 304 may include other functional elements (not illustrated) to allow for charging energy storage elements 322 and 324 with a rectified waveform received from rectifier 302.

In one embodiment, regulator 312 may be a boost-type voltage regulator that provides an input voltage to circuitry 316 which may be greater than the voltage level received from capacitive energy storage element 304. In this embodiment, only one super capacitor 322 may be needed, although more than one super capacitor may be configured in a parallel arrangement.

In another embodiment, regulator 312 may be a linear voltage regulator or a switching voltage regulator that provides an input voltage to circuitry 316 which may be less than or about equal to a voltage level received from capacitive energy storage element 304. In this embodiment, more than one super capacitor 322 may be used, and the super capacitors may be arranged in a series configuration (as illustrated) to provide a higher combined voltage. Additional super capacitors may be added (e.g., in parallel) to provide additional current capacity. In these embodiments, regulator 312 may provide a regulated output voltage to circuitry 316, which may be in the range of approximately two to four volts, for example.

In one embodiment, super capacitor 322 may have a high storage density and may have a capacitance of one or more Farads. Super capacitor 322 may be chemically inert (i.e., not including a battery or be a battery-capacitor hybrid) and may have radially configured double layer plates. Super capacitor 322 may also be hermetically sealed and have an electrolyte that does not freeze at temperatures of up to −45 degrees F. Super capacitor 322 may also be able to withstand shock forces of up to 15,000 g's and greater during projectile launching operations without failure. The charge and/or discharge rate of super capacitor 322 may be at least 15 Joules per second allowing super capacitor 322 to store up to 15–20 watts in less than two seconds, for example. Super capacitor 322 may be referred to as a "quick-charge" capacitor.

Although projectile circuitry 300 is illustrated as having several functional elements 302–320, one or more of these functional elements may be combined with other functional elements and may be fabricated from various combinations of hardware and software configured elements.

Figure 4:
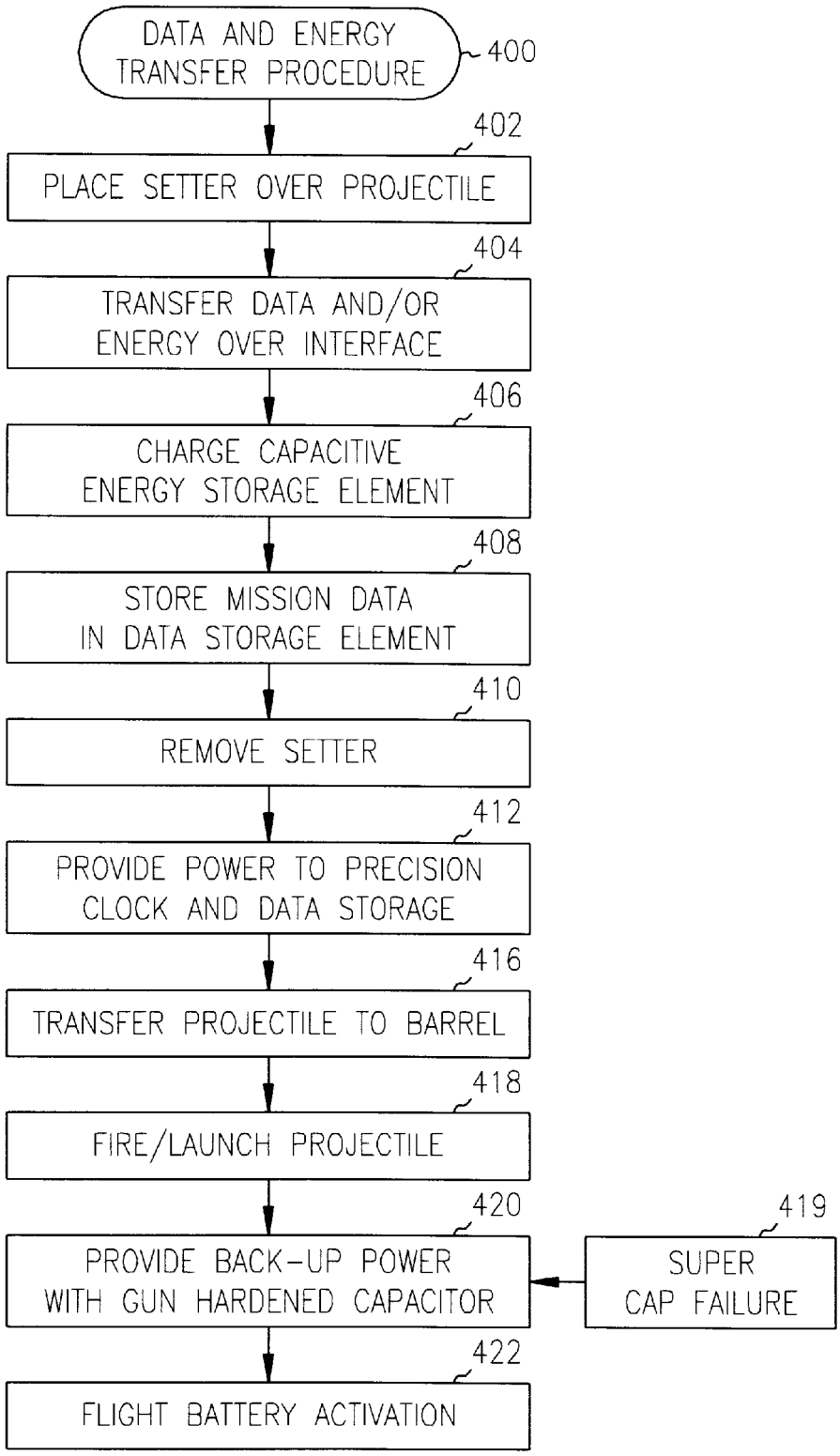
FIG. 4 is a flow chart of a data and energy transfer procedure in accordance with an embodiment of the present invention.

FIG. 4 is a flow chart of a data and energy transfer procedure in accordance with an embodiment of the present invention. Data and energy transfer procedure 400 may be performed by a projectile setting system, such as system 100 (FIG. 1), although other systems are also suitable. Although the individual operations of procedure 400 are illustrated and described as separate operations, one or more of the individual operations may be performed concurrently and nothing requires that the operations be performed in the order illustrated.

In operation 402, a projectile setter may be placed over a projectile. Operation 402 may establish a connector-less or an inductive interface, such as interface 118 (FIG. 1), between setter circuitry 102 (FIG. 1) and projectile circuitry 106 (FIG. 1). Operation 402 may alternatively establish an electro-mechanical interface. In the case of an electromechanical interface, operation 402 may include electrically coupling the setter and projectile circuitry. In operation 404, data and/or energy are transferred over the interface from the setter circuitry to the projectile. The energy may take the form of an AC waveform and the data may be modulated on the waveform.

In operation 406, a capacitive energy storage element, such as energy storage element 114 (FIG. 1), may be charged. The charging may be performed rapidly allowing up to 25 watts or more of energy to be stored on the capacitive energy storage element in less than a few seconds. Operation 406 may include charging primary and back-up energy storage elements of the capacitive energy storage element. In operation 408, mission data may be stored in a data storage element, such as data storage element 112 (FIG. 1). In one embodiment, operations 404 through 408 may be performed substantially simultaneously. During operations 404 through 408, power to the projectile circuitry may be supplied from an external means.

In operation 410, the projectile setter may be removed from over the projectile, which may terminate the interface established in operation 402. In the case of an electromechanical interface, operation 410 may include electrically decoupling the setter and projectile circuitry.

In operation 412, a primary storage element of the capacitive energy storage element may provide energy to circuitry, such as circuitry 316 (FIG. 3), until another energy source becomes available. In one embodiment, the capacitive energy storage element may provide energy to the circuitry from the time the projectile is removed from the projectile setter until after launch. This may include the time during which the projectile is transferred to a gun barrel for loading in operation 414, and the time subsequent to launch in operation 416 until a flight battery becomes available. In this embodiment, the capacitive energy storage element may replace a data-hold battery used in conventional guided projectiles.

In operation 418, a backup-energy storage element, such as a gun-hardened capacitor, may provide energy to circuitry, such as circuitry 316 (FIG. 3), in the event of failure 419 of the primary capacitive energy storage element. For example, if super capacitor 322 (FIG. 3) fails during launching operations, gun-hardened capacitor 324 may provide power to the clock circuitry until the flight battery becomes available. In this situation, gun-hardened capacitor 324 may provide power to the clock circuitry for a relatively short amount of time (e.g., less than two seconds) from launch until activation of the flight battery.

In operation 420, another energy source, such as fight battery 320 (FIG. 3), may be activated and becomes available. In operation 420, the capacitive energy storage element may refrain from providing energy to the clock circuitry.

The foregoing description of specific embodiments reveals the general nature of the invention sufficiently that others can, by applying current knowledge, readily modify and/or adapt it for various applications without departing from the generic concept. Therefore such adaptations and modifications are within the meaning and range of equivalents of the disclosed embodiments. The phraseology or terminology employed herein is for the purpose of description and not of limitation. Accordingly, the invention embraces all such alternatives, modifications, equivalents and variations as fall within the spirit and broad scope of the appended claims.

What is claimed is:

1. An apparatus to store energy and data comprising:

a capacitive energy storage element to receive and store energy transferred over an inductive interface;

a data storage element to receive data transferred over the interface concurrently with the energy with a combined data and energy signal;

circuitry to receive power from the capacitive energy storage element; and a regulator coupled to an output of the capacitive storage element to regulate an input voltage of the circuitry.

2. The apparatus of claim 1 wherein the capacitive energy storage element, data storage element and the circuitry are part of a guided projectile, and wherein the capacitive energy storage element receives the energy transferred over the inductive interface, the data storage element receives mission data transferred over the inductive interface, and the circuitry receives the power from the capacitive energy storage element during projectile loading and firing.

3. The apparatus of claim 2 wherein the inductive interface is comprised of first and second windings, the first windings being part of a projectile setter, the second windings being part of the guided projectile.

4. The apparatus of claim 1 further comprising:

a rectifying element to rectify a signal from the interface, the signal including the energy and mission data; and a data extraction element to extract the mission data from the signal and provide the extracted mission data to the data storage element.

5. The apparatus of claim 4 wherein the rectifying element is coupled to the capacitive storage element to provide the received energy to the capacitive storage element.

6. The apparatus of claim 1 wherein the capacitive energy storage element is comprised of at least one super capacitor having a capacitance of at least one Farad and having a charge rate of at least 15 Joules per second.

7. The apparatus of claim 1 wherein the regulator is either a linear voltage regulator or a switching voltage regulator, and wherein the input voltage of the circuitry is lower than an output voltage of the capacitive storage element.

8. The apparatus of claim 1 wherein the regulator is a boost-type voltage regulator, and wherein the input voltage of the circuitry is greater than an output voltage of the capacitive storage element, and wherein the capacitive energy storage element is comprised of at least one super capacitor.

9. An apparatus to store energy and data comprising:

a capacitive energy storage element to receive energy transferred over an interface;

a data storage element to receive data transferred over the interface; and circuitry to receive power from the capacitive energy storage element, wherein the capacitive energy storage element is comprised of:

at least one super capacitor;

a gun-hardened capacitor; and one-way energy transfer elements between the at least one super capacitor and the gun-hardened capacitor.

10. The apparatus of claim 9 wherein the capacitive energy storage element, data storage element and the circuitry are part of a guided projectile, and wherein the capacitive energy storage element receives the energy transferred over an inductive interface, the data storage element receives mission data transferred over the inductive interface, and the circuitry receives the power from the capacitive energy storage element during projectile loading, and wherein the circuitry receives power from the gun-hardened capacitor when the super capacitor fails during projectile launching.

11. An apparatus to store energy and data comprising:

a capacitive energy storage element to receive energy transferred over an interface;

a data storage element to receive data transferred over the interface;

circuitry to receive power from the capacitive energy storage element;

a regulator coupled to an output of the capacitive storage element to regulate an input voltage of the circuitry, wherein the regulator is either a linear voltage regulator or a switching voltage regulator, and wherein the input voltage of the circuitry is lower than an output voltage of the capacitive storage element, and wherein the capacitive energy storage element is comprised of a plurality of super capacitors arranged in a series configuration.

12. A method for storing energy and data comprising:

receiving energy and data over an interface;

charging a capacitive storage element with the received energy;

storing the received data in a data storage element; and providing at least some of the energy stored in the capacitive storage element to clock circuitry and the data storage element until another energy source is activated, wherein the energy and data are received over an inductive interface of a guided projectile, and wherein the data is mission data for the guided projectile, and wherein the another energy source includes a flight battery of the guided projectile.

13. The method of claim 12 further comprising providing at least some of the energy stored in the capacitive storage element to clock circuitry and the data storage element until another energy source is activated.

14. The method of claim 12 wherein receiving, charging and storing are performed during projectile setting operations, and the providing is performed subsequent to the projectile setting operations and during a launching operation of the guided projectile.

15. The method of claims 12 wherein charging the capacitive storage element comprises charging a super capacitor.

16. The method of claim 15 wherein charging further comprises charging a gun-hardened capacitor, and wherein the method further comprises providing energy stored in the gun-hardened capacitor to the clock circuitry when the super capacitor fails during the launching operation.

17. The method of claim 12 wherein receiving comprises receiving the energy and the mission data over the inductive interface from a projectile setter.

18. A system to transfer energy and mission data for a guided projectile comprising:

projectile setting circuitry to transfer mission data and energy concurrently over an inductive interface with a combined data and energy signal; and projectile receiving circuitry to receive the energy and mission data from the interface, the projectile receiving circuitry comprising a capacitive energy storage element to store the energy, a data storage element to store the mission data, and clock circuitry to receive power from the capacitive energy storage element during projectile loading, wherein the interface is an electromechanical interface comprised of a mechanical connector and wherein the data storage element receives power from a gun-hardened capacitor when a super capacitor fails during the launching operation.

19. A system to transfer energy and mission data for a guided projectile comprising:

projectile setting circuitry to transfer mission data and energy over an interface; and projectile receiving circuitry to receive the energy and mission data from the interface, the projectile receiving circuitry comprising a capacitive energy storage element to store the energy, a data storage element to store the mission data, and clock circuitry to receive power from the capacitive energy storage element during projectile loading, wherein the capacitive energy storage element is comprised of:

at least one super capacitor;

a gun-hardened capacitor; and one-way energy transfer elements coupled between the at least one super capacitor and the gun-hardened capacitor, wherein a regulator is coupled to an output of the capacitive storage element to regulate an input voltage of the clock circuitry, and wherein the clock circuitry receives power from the gun-hardened capacitor when the super capacitor fails during the launching operation.

20. A guided projectile comprising:

a capacitive energy storage element to receive energy transferred over an inductive interface;

a data storage element to receive mission data transferred over the inductive interface concurrently with the energy with a combined data and energy signal; and precision clock circuitry to receive power from the capacitive energy storage element during loading and firing of the guided projectile, wherein the capacitive energy storage element includes at least one super capacitor, and a gun-hardened capacitor, and wherein the precision clock circuitry receives power from the gun-hardened capacitor when the super capacitor fails during projectile launching.

21. A guided projectile comprising:

a capacitive energy storage element to receive energy transferred over an inductive interface, the capacitive energy storage element including at least one super capacitor, and a gun-hardened capacitor;

a data storage element to receive mission data transferred over the inductive interface;

precision clock circuitry to receive power from the capacitive energy storage element during loading and firing of the guided projectile, the precision clock circuitry to receive power from the gun-hardened capacitor when the super capacitor fails during projectile launching;

a rectifying element to rectify a signal from the inductive interface, the signal including the energy and mission data;

a data extraction element to extract the mission data from the signal and provide the extracted mission data to the data storage element; and a regulator coupled to an output of the capacitive storage element to regulate an input voltage of the precision clock circuitry, wherein the inductive interface is comprised of a first and second windings, the first windings being part of a projectile setter, the second windings being part of the guided projectile, and wherein the capacitive energy storage element further includes one-way energy transfer elements between the at least one super capacitor and the gun-hardened capacitor.

* * * * *